US006178758B1

(12) United States Patent
Schwarzpaul

(10) Patent No.: US 6,178,758 B1
(45) Date of Patent: Jan. 30, 2001

(54) REFRIGERATING SYSTEM

(75) Inventor: Uwe Schwarzpaul, Siegen (DE)

(73) Assignee: Electrolux Siegen GmbH, Siegen (DE)

( * ) Notice: Under 35 U.S.C. 154(b), the term of this patent shall be extended for 0 days.

(21) Appl. No.: 09/276,286

(22) Filed: Mar. 25, 1999

Related U.S. Application Data

(63) Continuation-in-part of application No. 08/949,544, filed on Oct. 14, 1997, now abandoned.

(30) Foreign Application Priority Data

Oct. 16, 1996 (DE) ..... 196 42 745

(51) Int. Cl.[7] ..... F25B 49/02
(52) U.S. Cl. ..... 62/129; 62/158
(58) Field of Search ..... 62/125, 126, 127, 62/129, 130, 227, 228.1, 228.3, 228.4, 228.5, 157, 158, 231

(56) References Cited

U.S. PATENT DOCUMENTS

| | | | |
|---|---|---|---|
| 2,120,825 | 6/1938 | Wolfert | 62/126 X |
| 2,582,837 | 1/1952 | Leonard, Jr. | 62/126 |
| 3,123,984 | 3/1964 | Leonard, Jr. | 62/127 X |
| 4,407,141 | 10/1983 | Paddock | 62/130 |
| 4,894,643 | 1/1990 | Thompson et al. | 62/131 X |
| 5,186,014 * | 2/1993 | Runk | 62/129 |

FOREIGN PATENT DOCUMENTS

| | | |
|---|---|---|
| 41 13 170 A1 | 11/1991 | (DE) . |
| 43 30 923 C1 | 3/1995 | (DE) . |
| 2 257 244 | 1/1993 | (GB) . |

* cited by examiner

*Primary Examiner*—Harry B. Tanner
(74) *Attorney, Agent, or Firm*—Pearne & Gordon LLP

(57) ABSTRACT

A refrigerating system is proposed which comprises a cooling circuit 7 for cooling a cooling room 3, the cooling circuit 7 comprising an evaporator 9 arranged in the cooling room 3 and passed by a coolant and the power to be supplied to the cooling circuit 7 being adjustable, a control device 23 for making available to the cooling circuit 7 a performance value stating the power to be supplied, a temperature sensor 27 for making available to the control device 23 a temperature measurement value essentially stating the temperature of the coolant in the evaporator 9, a clock 29 for making available to the control device 23 a predetermined first time interval and a pre-determined second time interval following the first time interval, wherein the control device 23 during the first time interval makes available a first performance value stating an essentially constant first power to be supplied and after the end of the first time interval makes available a second performance value stating a second power to be supplied which is greater than the first power to be supplied, wherein the control device 23 at the beginning of the second time interval detects a first temperature value and at the end of the second time interval detects a second temperature value and issues a defect signal when the absolute value of difference between the first and the second temperature values is less than a pre-determined value of difference.

12 Claims, 2 Drawing Sheets

REFRIGERATING SYSTEM

Figure 1:
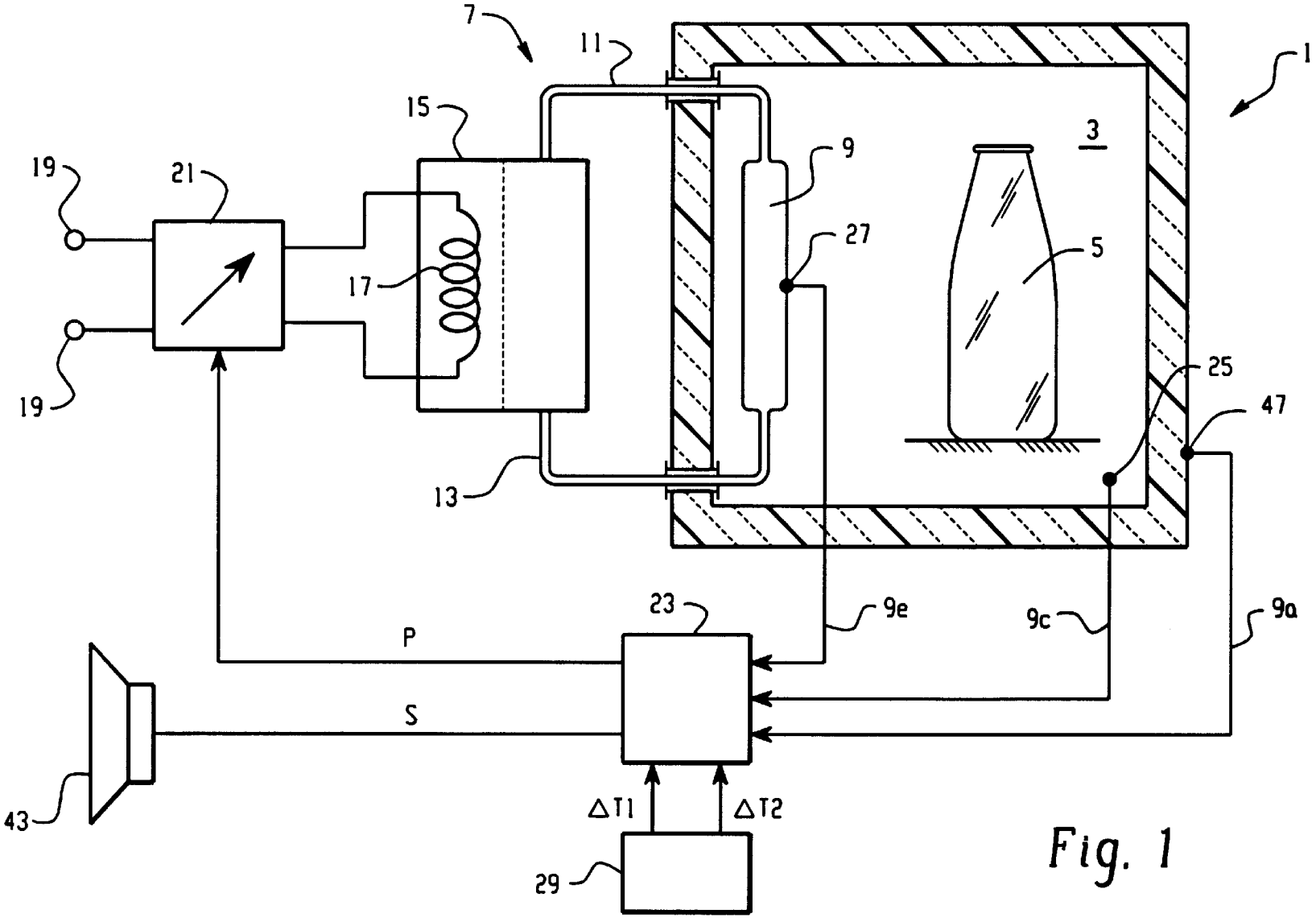

The present application is a continuation-in-part of application Ser. No. 08/949,544 filed Oct. 14, 1997 now abandoned.

The present invention pertains to a refrigerating system with a refrigerating circuit for cooling a cooling room and to such a refrigerating system in particular, with a control means for detecting a defect of the cooling circuit.

A cooling circuit of the above kind includes an evaporator arranged in a cooling room to be cooled and passed by a coolant which enters the evaporator in cooled form, absorbs heat there and subsequently leaves the evaporator in heated form. Outside of the cooling room a unit is provided for, which again cools down the coolant exiting the evaporator and anew supplies it to the evaporator. However, energy or power, respectively, has to be supplied to said unit to enable it to carry out this cooling function of the coolant. This energy or power, respectively, in case of a compression circuit can be supplied to the cooling circuit e.g. by means of a compressor or in case of an absorption circuit—by means of a heating means.

Defects occurring in these cooling circuits can be coolant losses due to leakages, defects at the unit of energy or power supply, respectively, to the cooling circuit and others.

However, under certain circumstances such defects can be detected with difficulty only: Due to fabrication spreads, in absorption cooling circuits the efficiency may very from apparatus to apparatus. As a consequence, a final temperature achieved by the refrigerating unit, in the cooling room can differ from apparatus to apparatus so that for sure a conclusion as to a defect can for sure not be drawn on basis of the final temperature in the cooling room alone.

Furthermore, the final temperature achievable in the cooling room also depends on the ambient temperature. In addition, the time required for essentially reaching the final temperature during cooling down of a unit depends on the charging condition of the cooling room, a heavily charged cooling room e.g. under certain circumstances requiring distinctly long time for reaching its final temperature. Thus, it may happen that at a given time the actually possible final temperature has not yet been reached and in case of exclusive detection of the cooling room temperature existence of a defect could be concluded erroneously. Further dependencies result from the installation situation of the refrigerating unit so that here e.g. ventilation and cooling of a heat exchanger can be influenced.

However, it nevertheless is desirable that a defect in the cooling circuit is detected as soon as possible in order to request repair of the defect or taking the apparatus out of service. In particular leakages occurring in case of cooling circuits operated with ammonia can cause interference, maybe annoyance caused by bad smell, for a user of the refrigerator, this being the reason why also in this case early detection of defects of the cooling circuit is of great importance.

Thus, it is an object of the present invention to make available a refrigerating system with a cooling circuit permitting detecting of defects of the cooling circuit.

For solving this object, a refrigerating system is proposed which includes:

a cooling circuit for cooling a cooling room, said cooling circuit comprising an evaporator arranged in said cooling room and being passed by a coolant and the power supplied to said cooling circuit being adjustable, a control means for providing a performance value stating the power to be supplied, to said cooling circuit, a temperature sensor for providing a temperature measurement value essentially stating the temperature of the coolant in the evaporator, to said control means, a clock for providing a given first time interval and a second given time interval subsequent to said first time interval, to said control means, said control means during said first time interval providing a performance value stating a first essentially constant power to be supplied and upon termination of said first time interval providing a second given performance value stating a second power to be supplied, being greater than said first power to be supplied, and wherein said control means at the beginning of said second time interval detects a first temperature value and at the end of said second time interval detects a second temperature value and issues a defect signal when the absolute value of the difference between said first and said second temperature values is less than a given value of difference.

The invention is based on the idea of not carrying out detection of a defect of the cooling circuit in an essentially stationary condition of the refrigerating system but to cause a non-stationary condition of the cooling circuit, in which parameters of the cooling circuit are subject to a notable temporal variation. From these temporal changes then conclusion is drawn to a correct function or to a defect, respectively, of the cooling circuit. In accordance therewith in accordance with the present invention the power to be supplied to the cooling circuit is adjusted to a first performance value during a first time interval and upon expiry of said first time interval the power supplied to the refrigerator is changed into a second performance value being larger than said first performance value, during a second time interval. Due to the difference between said first and said second performance values the non-stationary condition of the cooling circuit is brought about.

In accordance with the present invention the temperature of the coolant in the evaporator is provided as parameter of the cooling circuit, whose detection in the non-stationary condition forms a sensible indicator for the presence of a defect. Correspondingly, the refrigerating system comprises a temperature sensor which essentially records the temperature of the coolant in the evaporator and provides a temperature measurement value essentially reflecting said temperature.

With entry into the non-stationary condition, a control means in the beginning of the second time interval detects a first temperature value of said temperature sensor and in the end of said second time interval it detects a second temperature value of said temperature sensor. Subsequently, the control means calculates the difference of said two temperature values. If the absolute value of said difference is larger than a given value of difference, the control means concludes that no defect is present since the cooling circuit reacted on the changed condition sufficiently quickly. If the absolute value, however, is less than the given value of difference, the defect means concludes presence of a defect as the cooling circuit did not react on the changed operating condition in sufficient way and issues a corresponding defect signal.

Preferably, said first performance value is chosen such that it states a power supplied of essentially zero. This means that during said first time interval the cooling circuit is not effective and the cooling room is not cooled further. This time thus can be used for defrosting the evaporator and/or the cooling room, respectively. Herein it is advantageous that the period of said first time interval is defined such that defrosting as complete as possible, of the evaporator and/or the cooling room, respectively, is reached.

To permit reproducibility as good as possible, of detection, said second performance value at least in the beginning of said second time interval states an essentially constant power to be supplied.

However, it also is possible to carry out regulation of the cooling circuit already during said second time interval such that a temperature detected by a cooling room temperature sensor, of the cooling room assumes a given desired value. This measurement is meaningful in particular, when the above-mentioned essentially constant power to be supplied during the entire second time interval would cause cooling down of the cooling room below the given desired temperature thereof.

A particularly preferable solution results when in the beginning of said second time interval an essentially constant power is supplied and in the end of said time interval the power to be supplied is determined in dependence on the cooling room temperature measurement value.

For on one hand achieving an essentially continuous cooling of the cooling room and the objects stored therein and for on the other hand detecting possibly occurring defects as early as possible, the non-stationary condition of said cooling circuit is generated in periodical intervals and therein defect detection is carried out. The corresponding periods can be chosen such that defect detection is carried out during the night, between 3:00 and 4:00 h a.m. e.g.. Then, a user of the refrigerating system is to a large extent not affected by the heating of the objects stored in the cooling room, accompanying defect detection.

The beginning and the duration of the first and/or second time intervals and/or the value of difference can be absolutely predetermined in dependence on the remaining parameters of said refrigerating system. Preferably, these values, however, also are determined in dependence on the temperature prevailing in the cooling room prior to beginning of defect detection or on the ambient temperature. Hereby, influences of the cooling room temperature and/or ambient temperature, which also co-determine the non-stationary condition of the cooling circuit are accounted for during defect detection.

Said temperature sensor is to detect a measurement value being subject to a rate of change as large as possible due to the non-stationary condition of the cooling circuit. For this reason, the temperature sensor is to be in thermally conducting contact with the coolant in the position of the evaporator. Said temperature sensor herein can protrude into the coolant in the evaporator or can be located outside of the evaporator, a thermally conducting connection existing to an outside surface of the evaporator. By essentially detecting the temperature of the coolant in the evaporator, said temperature sensor differs from a further sensor essentially detecting the temperature of the cooling room. The latter sensor preferably is used for regulating the cooling circuit during continuous operation, as it represents the temperature in the cooling room and thus also the temperature of the objects stored in said cooling room. A regulation of the cooling circuit such that these objects are kept on a given temperature, is what the user of the refrigerating system is interested in. Therefore, for regulating the temperature in the cooling room during continuous operation preferably a cooling room temperature sensor is used, which differs from the temperature sensor essentially used for defect detection, which essentially detects the temperature of the coolant in the evaporator.

The cooling circuit preferably is an absorption cooling circuit, the energy and/or power, respectively, supplied to said absorption cooling circuit being supplied through a radiator heating a medium in an expeller of said absorption cooling circuit. The above defect detection herein is particularly advantageously usable in an absorption cooling circuit including ammonia as coolant, as there a defect, i.e. leakage, causes interference with a user. Upon detection and communication of the occurrence of defect the apparatus is switched off.

In the following the invention is explained with reference to drawings. Therein

Figure 2:
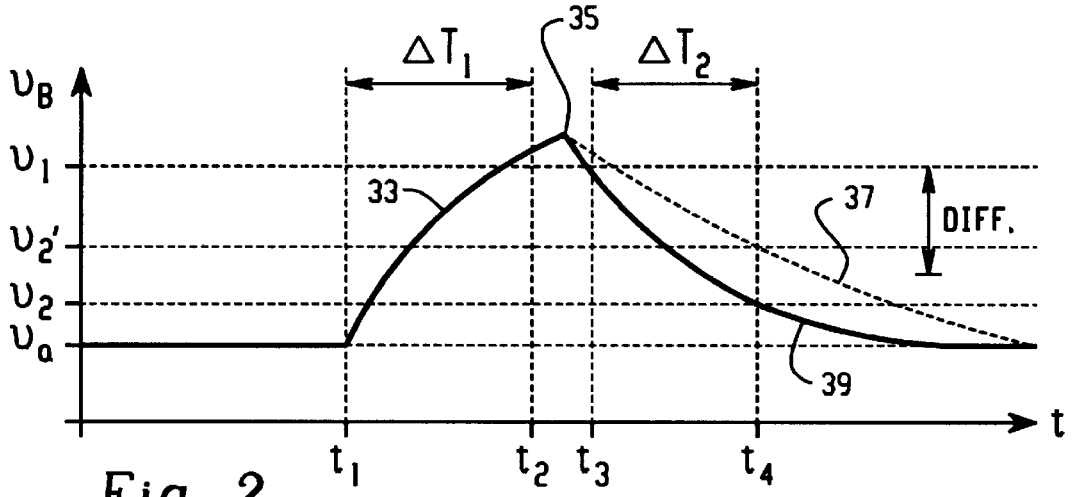
Figure 3:
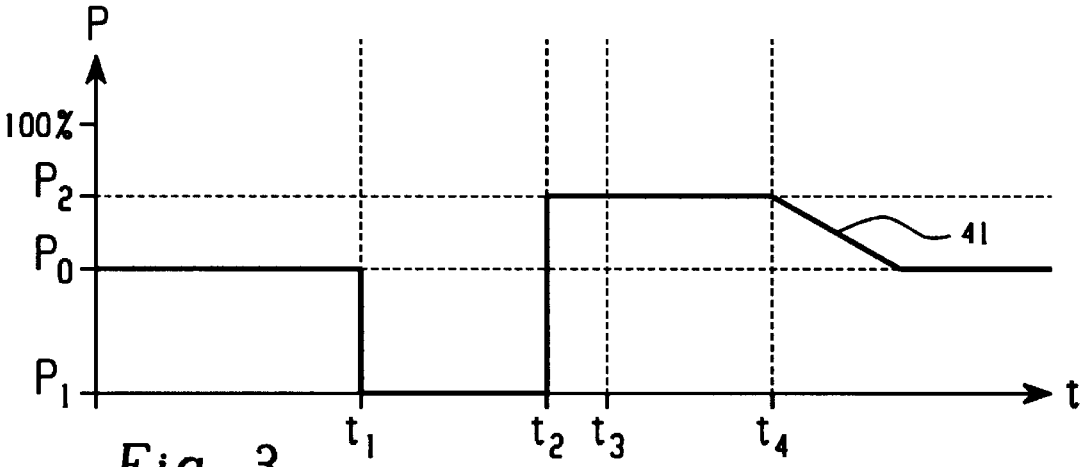
Figure 4:
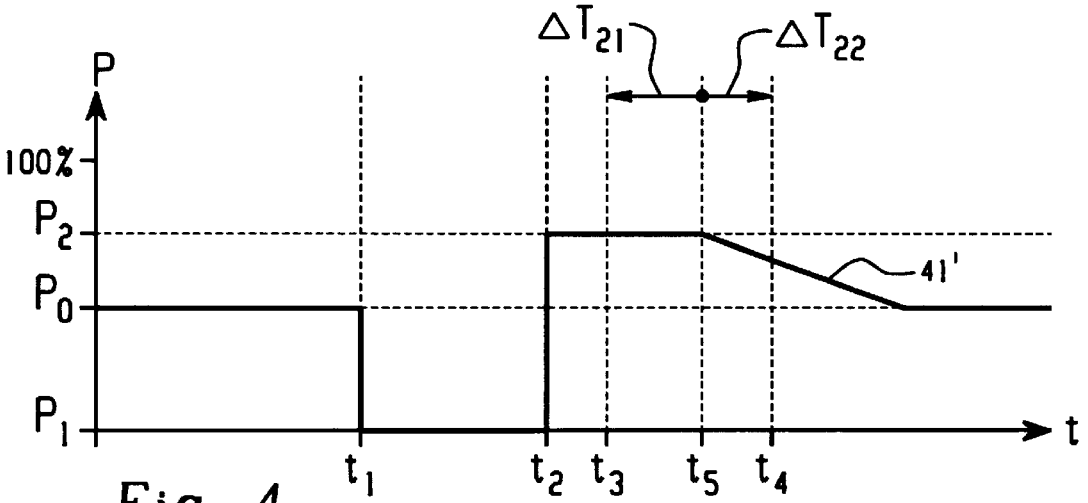

FIG. 1 shows a schematic function diagram of the refrigerating system in accordance with the present invention, FIG. 2 shows a time table stating the temporal course of a temperature detected by a temperature sensor of the refrigerating system of FIG. 1, FIG. 3 shows a time table stating a power supplied to the cooling circuit of FIG. 1 in dependence on time, and FIG. 4 shows a modification of the time course shown in FIG. 3.

In FIG. 1 a refrigerating system 1 for cooling a cooling room 3 including objects 5 arranged therein is shown schematically. Said refrigerating system is part of a refrigerator in from of a "mini bar" which again is part of equipment of a hotel room. Cooling of said cooling space 3 is effected using a cooling circuit 7 whose evaporator 9 is passed by a coolant, is supplied through a supply line 11 in cooled form and is removed from said evaporator 9 through an outlet line 13 in heated form. Cooling of the heated coolant exited from the evaporator 9 through the outlet line 13 till to the supply line 11 is effected by means of a cooling means 15 which in FIG. 1 is indicated only schematically and which includes a reservoir for the coolant including ammonia and water, an expeller, a condenser and an absorber.

Energy and/or power, respectively, is supplied to the expeller by means of a resistance radiator 17 being in thermally conductive contact therewith. The current supplied to said resistance radiator 17 is taken from a current source or mains supply through terminals 19 and is controlled by a power switch means 21 working on the principle of pulse width modulation (PWM). A scan order to be used by said power switch circuit 21 for power supply to said resistance radiator 17 is made available to said power switch circuit 21 as a performance value P by a control 23. By means of the performance value P transmitted to said power switch circuit 21, said control 23 thus determines which power is to be supplied to the cooling circuit through said resistance radiator 17.

During standard operation of said refrigerating system 1, said control 23 determines the power P to be supplied in dependence on a temperature of the cooling room 3, for which purpose a cooling room temperature sensor 25 transmitting a cooling room temperature measurement value $\upsilon_a$ to the control 23 is provided for within said cooling room 3. Said control 23 therein determines the power P such that said cooling room temperature measurement value $\upsilon_c$ corresponds to a desired temperature value e.g. given by a user.

Said refrigerating system 1 further includes a temperature sensor 27 disposed on the external surface of said evaporator 9. Said temperature sensor 27 therein essentially detects the temperature of the coolant in said evaporator 9 and transmits said temperature as temperature measurement value $\upsilon_e$ to said control 23.

Said refrigerating system 1 is capable of detecting defects of the cooling circuit 7. For this purpose, it includes a clock means 29 fixing the start of such defect detection and transmitting to said control 23 a first time interval $\Delta\delta T1$ and a second time interval $\Delta T2$.

The function of defect detection will be explained in the following with reference to FIGS. 2 and 3.

In FIG. 2 the temporal course of the temperature measurement value $\upsilon_e$ detected by the temperature sensor 27 disposed on the evaporator 9 is shown, whereas FIG. 3 represents the temporal course of the power P supplied to the cooling circuit 7.

Starting with a time $t_1$ said cooling circuit is in stationary operation: The cooling room temperature essentially corresponds to the desired value, the temperature of the coolant in the evaporator has an essentially constant temperature $\upsilon_0$ for compensating the losses of thermal conduction of the coolant, for this purpose a power $P_0$ of about 50 percent of the maximum power of the resistance radiator 17 being supplied to said resistance radiator 17.

The clock means 27 provides two time intervals for defect detection. The first time interval starts at time $t_1$, has a duration of $\Delta T1$ of 2 hours and ends at a time $t_2$. The second time interval starts at a time $t_3$, has a duration of $\Delta T2$ of about 1 hour and ends at a time $t_4$. Said second time interval is arranged subsequently to said first time interval, a period of 10 minutes lying between the end $t_2$ of said first time interval and the beginning $t_3$ of said second time interval.

At the time $t_1$, i.e. the beginning of said first time interval, said control 23 pre-determines a value P1 of essentially zero for the power to be supplied to the cooling circuit 7. Thereby, said cooling circuit 7 practically is switched off, resulting in that the evaporator 9 and the coolant contained therein increasingly heat up due to thermal conductivity, as is shown at measurement value $\upsilon_e$ in a curve section referred to with 33, of the FIG. 2. The duration $\delta T1$ of 2 hours therein is chosen so large that under usual operating conditions an essentially complete defrosting of said evaporator 9 and other surfaces subject to formation of ice in said cooling room 3 is effected.

With the end of the second time interval at the time $t_2$ the power to be supplied to the cooling circuit 7 is to adjusted to a value P2 approximately corresponding to 75 percent of the maximally possible power by the control 23. In response thereto the cooling circuit 7 again starts working, the temperature $\upsilon_e$ of the coolant in the evaporator still increasing directly upon new supply of power to the cooling circuit. After having passed a temperature maximum in a curve section 35 between the times $t_2$ and $t_3$ the temperature $\upsilon_e$ of the coolant in the evaporator 9 becomes colder and colder. This increasing cooling down of the coolant in the evaporator is the non-stationary condition of the cooling circuit 7, which is used for proper defect detection. Thus, said first time interval between $t_1$ and $t_2$ serves for creation of the non-stationary condition and said second time interval between $t_3$ and $t_4$ is used for actual defect detection.

At the time $t_3$ the control 23 reads a first temperature value $\upsilon_1$ from said temperature sensor 27 and at the time $t_4$ the control 23 reads a second temperature value $\upsilon_2$ from said temperature sensor 27. Because of the increasing cooling of the coolant in the evaporator said two temperature values $\upsilon_1$ and $\upsilon_2$ differ substantially.

After the time $t_4$ the course of the temperature value $\upsilon_e$ again asymptotically approaches the stationary value $\upsilon_0$. In FIG. 2 said asymptotic approach is represented with interrupted line 37 for a cooling circuit with defect and with continuous line 39 for a cooling circuit without defect, the approach for said cooling circuit with defect occurring slower than for said cooling circuit without defect.

After the end of the second time interval at the time $t_4$ the power supplied to the cooling circuit 7 in accordance with a regulation method not described any closer is gradually reduced from the value P2 increased for the purpose of defect detection, for again merging into the stationary condition with a cooling room temperature essentially corresponding to the desired value. This reduction of the supplied power is shown in FIG. 3 by a curve piece 41.

As can be seen from FIG. 2, the control means 23 in the cooling circuit without defect at the time $t_4$ detects a temperature value $\upsilon_2$ of the coolant in the evaporator, which is less than the corresponding temperature value $\upsilon_2'$ of the coolant in the evaporator 9 in the cooling circuit with defect. Correspondingly, the temperature value $t_4$ detected at the time is used for defect detection in that the absolute value of the difference between the temperature values $\upsilon_1$, $\upsilon_2$ detected at times $t_3$ and $t_4$ is determined and compared to a given value of difference DIFF. If this difference is greater than the value of difference ($|\upsilon_1-\upsilon_2| \geqq \text{DIFF}$), the control means 23 finds that no defect is present.

If the difference of the temperature values, however, is less than the given value of difference ($|\upsilon_1-\upsilon_2| < \text{DIFF}$), the control 23 concludes that a defect exists in the cooling circuit 7 and issues a corresponding defect signal S to an acoustic warning means which issues a buzzer tone and, if applicable, also an optical signal for informing the user about the defect.

Defect detection thus is characterized by the following values: start and duration of said first time interval, interval between the end of said first time interval and the beginning of said second time interval, duration of said second time interval, magnitude of value of difference DIFF.

These values essentially are pre-determined by the properties of the model and the remaining parameters of the refrigerating system. It is, however, possible to perdetermine these values in attenuated manner prior to carrying out defect detection in that the cooling room temperature $\upsilon_c$ detected by said cooling room temperature sensor 25 and/or the temperature value $\upsilon_e$ detected by said coolant temperature sensor 27 are used for determination of these values. Furthermore, the refrigerating system 1 shown in FIG. 1 comprises a temperature sensor 47 for detecting an ambient temperature $\upsilon_a$ of an environment of the refrigerating system, this temperature value also being used for pre-determination of the values mentioned. It namely e.g. determines the difference between $\upsilon_c$ and $\upsilon_a$, the time period within which the value $\upsilon_e$ again assumes its stationary value after the end $t_2$ of said first time interval. Therefore, it is advantageous to generate the duration $\Delta T2$ of said second time interval independence on said difference.

In FIG. 4 a modification of the above-described embodiment is shown, FIG. 4 showing the temporal course of the power supplied to the cooling circuit 7. In contrast to FIG. 3, in FIG. 4 the second time interval starting at the time $t_3$ and ending at the time $t_4$, is subdivided into two partial intervals, namely a first time interval starting at the time $t_3$, having a duration $\Delta T21$ and ending at a time $t_5$, and a second partial interval starting at the time $t_5$, having a duration $\Delta T22$ and ending at the time $t_4$. Differing to FIG. 3, the essentially constant power P2 is not supplied to the cooling circuit 7 until the end of said second time interval but only during said first partial interval of said second time interval until the time $t_5$. Then, reduction of power supply up to the stationary value $P_0$ will already be started as of time $t_5$ in order to achieve accurate approach to the stationary condition of the cooling circuit. Hereby energy which is to be supplied to the cooling circuit can be saved as compared to the course shown in FIG. 3.

As alternative to the above-described embodiment, the cooling circuit however can also be a compression cooling circuit to which energy is supplied using a compressor.

Furthermore, differing to the above-described embodiment said second time interval can also directly follow said first time interval so that the times $t_2$ and $t_3$ are identical.

Alternatively or supplementary to the above-described supply of the defect signal to the acoustic warning means, the defect signal can also be supplied to a circuit switching off the cooling circuit after receipt of said defect signal. In the described embodiment this can be effected by interruption of power supply to the resistance radiator, i.e. the apparatus is switched off.

In addition it is provided that a plurality of refrigerating systems is connected to a central surveillance means, the individual refrigerating systems feeding the defect signal issued by them to said central surveillance means and said central surveillance means providing a warning signal, if at least one refrigerating system provides a defect signal. A preferred use of this measurement can e.g. be found in a hotel where one refrigerator respectively is disposed in a plurality of rooms. A defect in one of these refrigerators thus can be detected in a hotel center and the required measurements can be taken from there.

What is claimed:

1. Refrigerating system comprising:

a cooling circuit (7) for cooling a cooling room (3), said cooling circuit (7) comprising an evaporator (9) arranged in said cooling room (3) and passed by a coolant and the power to be supplied to said cooling circuit (7) being adjustable, a control means (23) for making available to said cooling circuit (7) a performance value (P) stating the power to be supplied, a temperature sensor (27) for making available to said control means (23) a temperature measurement value ($\upsilon_e$) essentially stating the temperature of said coolant in said evaporator (9), a clock (29) for making available to said control means (23) a pre-determined first time interval ($t_1$, $t_2$) and a pre-determined second time interval ($t_3$, $t_4$) following said first time interval ($t_1$, $t_2$), wherein said control means (23) during said first time interval ($t_1$, $t_2$) makes available a first performance value ($P_1$) stating an essentially constant first power to be supplied and after the end of said first time interval ($t_1$, $t_2$) makes available a second performance value ($P_2$) stating a second power to be supplied which is greater than said first power to be supplied, and wherein said control means (23) at the beginning ($t_3$) of said second time interval detects a first temperature value ($\upsilon_1$) and at the end ($t_4$) of said second time interval detects a second temperature value ($\upsilon_2$) and issues a defect signal (S) when said absolute value of difference between said first and said second temperature values ($\upsilon_1$, $\upsilon_2$) is less than a pre-determined value of difference (DIFF).

2. Refrigerating system as defined in claim 1, characterized in that said first performance value ($P_1$) states a power to be supplied of essentially zero.

3. Refrigerating system as defined in claim 1 or 2, characterized in that said second performance value ($P_2$) at least in a first partial interval ($t_3$, $t_5$) of said second time interval ($t_3$, $t_4$) states an essentially constant perdetermined power to be supplied.

4. Refrigerating system as defined in claim 1 or 2, characterized by a cooling room temperature sensor (25) for making available to said control means (23) a cooling room temperature measurement value ($\upsilon_c$) essentially stating the temperature of said cooling room (3).

5. Refrigerating system as defined in claim 4, characterized in that said control means (23) makes available said second performance value ($P_2$) at least in a second partial interval ($t_5$, $t_4$) of said second time interval ($t_3$, $t_4$) in dependence on said cooling room temperature measurement value ($\upsilon_c$).

6. Refrigerating system as defined in claim 3, characterized by a cooling room temperature sensor (25) for making available to said control means (23) a cooling room temperature measurement value ($\upsilon_c$) essentially stating the temperature of said cooling room (3), in which said control means (23) makes available said second performance value ($P_2$) at least in a second partial interval ($t_5$, $t_4$) of said second time interval ($t_3$,$t_4$) in dependence on said cooling room temperature measurement value ($\upsilon_c$), said second partial interval ($t_5$, $t_4$) occurring after said first partial interval ($t_3$, $t_5$).

7. Refrigerating system as defined in claim 1 or 2, characterized in that said clock (29) periodically repeats provision of said first time interval ($t_1$, $t_2$) and said second time interval ($t_3$, $t_4$) being subsequent thereto.

8. Refrigerating system as defined in claim 4, characterized in that said control means (23) at the start ($t_3$) of said first time interval detects said cooling room temperature measurement value ($\upsilon_c$) and depending on said cooling room temperature measurement value ($\upsilon_c$) pre-determines said first time interval ($t_1$, $t_2$) and/or said second time interval ($t_3$, $t_4$) and/or said value of difference (DIFF).

9. Refrigerating system as defined claim 1 or 2, characterized in that an ambient temperature sensor (47) is provided for detecting the ambient temperature ($\upsilon_a$) of an environment outside of said cooling room (3) and that said control means (23) pre-determines said first time interval ($t_3$, $t_4$) or/and said second time interval ($t_3$, $t_4$) or/and said value of difference (DIFF), in dependence on said ambient temperature ($\upsilon_a$).

10. Refrigerating system as defined in claim 1 or 2, characterized in that said temperature sensor (27) is in thermally conductive connection with an external surface of said evaporator (9).

11. Refrigerating system as defined in claim 1 or 2, characterized in that said cooling circuit is an absorption cooling circuit (7) comprising a radiator (17) for providing said cooling power.

12. Central surveillance means connected to a plurality of refrigerating systems as defined in claim 1 or 2 such that the defect signal made available by each refrigerating system is fed to said central surveillance means, said central surveillance means providing a warning signal when receiving a defect signal from at least one system.

* * * * *